US006213658B1

(12) United States Patent
Nishimura

(10) Patent No.: US 6,213,658 B1
(45) Date of Patent: Apr. 10, 2001

(54) SHEET SUPPLY APPARATUS

(75) Inventor: Yasuhiro Nishimura, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/524,915

(22) Filed: Mar. 14, 2000

(30) Foreign Application Priority Data

Mar. 16, 1999 (JP) ..... 11-070380

(51) Int. Cl.[7] ..... B41J 11/42
(52) U.S. Cl. ..... 400/582; 400/630
(58) Field of Search ..... 400/582, 633, 400/583, 596, 598, 631, 612, 630; 271/265.01, 147, 152, 184, 162, 164, 117, 126; 399/391, 393, 405

(56) References Cited

U.S. PATENT DOCUMENTS 3,583,540 * 6/1971 Bernard ..... 197/138
4,909,374 * 3/1990 Skrypalle ..... 198/371
5,016,051 * 5/1991 Morikawa et al. ..... 355/218
5,119,135 * 6/1992 Baldwin ..... 355/128
5,174,668 * 12/1992 Sakamoto et al. ..... 400/582
5,328,167 * 7/1994 Frank ..... 271/241
5,708,935 * 1/1998 Rabjohns ..... 399/193
5,732,307 * 3/1998 Yoshizuka et al. ..... 399/23
5,790,933 * 8/1998 Williams ..... 399/393
5,839,015 * 11/1998 Faguy et al. ..... 399/23
6,120,196 * 9/2000 Matsuda ..... 400/55

* cited by examiner

*Primary Examiner*—John S. Hilten
*Assistant Examiner*—Darius N. Cone
(74) *Attorney, Agent, or Firm*—Kanesaka & Takeuchi

(57) ABSTRACT

A sheet supply apparatus for supplying record sheets to an image forming apparatus, the sheet supply apparatus includes a sheet supply table for supporting the record sheets stacked thereon; vertically moving device for vertically moving the sheet supply table; sheet supply device provided above the sheet supply table and contacting a topmost record sheet of the record sheets for supplying the record sheets one by one from the topmost record sheet to the image forming apparatus; left and right movement instructing device for giving an instruction to move the sheet supply table in a direction orthogonal to a transfer direction of the print sheet; left and right moving device for moving the sheet supply table in response to an instruction from the left and right movement instructing device; and controller for executing a control of moving the sheet supply table downward by the vertically moving device when the left and right movement instructing device gives the instruction.

7 Claims, 9 Drawing Sheets

(a)

(b)

SHEET SUPPLY APPARATUS

BACKGROUND OF THE INVENTION

1. Field of the Invention

The present invention relates to a sheet supply apparatus for supplying record sheet to an image forming apparatus, and more particularly to a sheet supply machine having a vertically movable sheet supplying table supporting a plurality of record sheets stacked thereon in which an image forming position to the record sheet can be adjusted by moving the sheet supplying table right and left.

2. Description of the Related Art

An image forming apparatus for forming an image on record sheets, for example, record sheets for general use, uses the record sheets by loading the record sheets on a sheet supply table. Particularly, in the case of a stencil printing machine, high-speed printing can be carried out since printing operation is carried out by mounting a stencil sheet on a printing drum situated inside the machine and rotating the printing drum. In correspondence therewith, there is constructed a constitution in which a fairly large number of record sheets is loaded on the sheet supply table and the large number of the record sheets can be continuously supplied in a short period of time in correspondence with printing speed.

The sheet supply table is constituted such that the topmost record sheet disposed at sheet supply position is supplied to a print section situated inside the printing machine one by one. A scraper roller (sheet supply roller) of the sheet supply section is provided at the sheet supply position and record sheet can be continuously supplied to the inside of the apparatus by rotating the scraper roller.

Further, there is constructed a constitution in which the sheet supply table is controlled to elevate in correspondence with supply of the record sheet and the topmost record sheet is always brought into contact with the scraper roller.

According to the record sheet, a position thereof in the left and right direction (width direction orthogonal to a transfer direction) is made variable in supplying the record sheet from the sheet supply table to the print section to thereby enable to move an image forming position in the left and right direction on the record sheet. For example, in the case of a stencil printing machine, by making variable a transfer position in the left and right direction of the record sheet relative to the printing drum, a contact position of the record sheet relative to an image position of stencil sheet mounted to the printing drum can be made variable in the left and right direction, so that the image forming position on the record sheet can be moved in the left and right direction.

FIG. 9 is a perspective view showing a sheet supply apparatus. A sheet supply table 50 loaded with the record sheets is provided with a dial 51 for moving the sheet supply table 50 in the left and right direction. By manually adjusting the dial 51, a screw shaft 52 is rotated, a nut portion 53 fixed to the sheet supply table 50 is moved in the left and right direction, thereby moving the sheet supply table 50 in the same direction. Thus, an image forming position on a record sheet P can be adjusted to move in the left and right direction.

The topmost one of the record sheets P loaded on the sheet supply table 50 is brought into contact with a scraper roller 57*a* of sheet supply means 57 provided above the sheet supply table 50 and the record sheet is supplied one by one from the topmost sheet to a print section by rotating the scraper roller 57*a*.

The sheet supply table 50 is constituted such that the sheet supply table 50 is controlled to elevate gradually in compliance with supply of the record sheet P and the topmost record sheet P is always brought into contact with the scraper roller 57*a* and can be supplied to the print section.

However, according to the above-described constitution, if the sheet supply table 50 is moved while the scraper roller 57*a* contacts the record sheet P for adjusting the image forming position on the record sheet P in the left and right direction, the record sheet P is supplied in an oblique direction by being rubbed with the scraper roller 57*a*, thereby causing sheet supply jamming in next printing operation. Further, the scraper roller 57*a* is also damaged. This accelerates deterioration in printing performance of the sheet supply apparatus.

Further, a conventional printer is constituted such that the left and right movement can be conducted regardless of printing operation. Therefore, if the sheet supply table is moved in the left and right direction during printing, conveying force may be exerted in an oblique direction on the record sheet, thereby causing record sheet jamming.

Then, it is possible that the sheet supply table is electrically moved in the left and right direction by means such as a motor instead of the manual operation stated above. However, the above-mentioned problems cannot be solved at all merely by adopting such constitution that the sheet supply table is moved in the left and right direction by motor power. Additionally, if the motor is energized while the scraper roller contacts the record sheet; excessive electric power is consumed due to friction between the scraper roller and the record sheet in comparison with the case where no friction occurs therebetween. This deteriorates electrical efficiency and leads to overheating and life-time deterioration of the motor

SUMMARY OF THE INVENTION

The present invention has been carried out in order to resolve the above-described problems and it is an object of the present invention to provide a sheet supply apparatus capable of keeping printing quality by avoiding occurrence of the record sheet rubbing when the image forming position is adjusted in the left and right direction. Additionally, it is another object of the present invention to provide a sheet supply apparatus capable of stably supplying the record sheets by controlling the left and right movement of the sheet supply table in accordance with sheet supplying operation.

According to a first aspect of the present invention, there is provided a sheet supply apparatus for supplying record sheets to an image forming apparatus, the sheet supply apparatus includes a sheet supply table for supporting the record sheets stacked thereon; vertically moving device for vertically moving the sheet supply table; sheet supply device provided above the sheet supply table and contacting a topmost one of the record sheets for supplying the record sheets one by one from the topmost record sheet to the image forming apparatus; left and right movement instructing device for giving an instruction to move the sheet supply table in a direction orthogonal to a transfer direction of the record sheet; left and right moving device for moving the sheet supply table in response to an instruction from the left and right movement instructing means; and control device for executing a control of moving the sheet supply table downward by the vertically moving device when the left and right movement instructing device gives the instruction.

According to a second aspect of the present invention, there is provided a sheet supply apparatus for supplying record sheets to an image forming apparatus, the sheet supply apparatus includes a sheet supply table for supporting the record sheets stacked thereon; vertically moving device for vertically moving the sheet supply table; sheet supply device provided above the sheet supply table and contacting a topmost one of the record sheets for supplying the record sheets one by one from the topmost record sheet to the image forming apparatus; sheet supply position detecting device for detecting whether the topmost record sheet is situated to a sheet supply position where the topmost record sheet is contacted with the sheet supply device; left and right movement instructing device for giving an instruction to move the sheet supply table in a direction orthogonal to a transfer direction of the record sheet; left and right moving device for moving the sheet supply table in response to an instruction from the left and right movement instructing means; and control device for executing a control of moving the sheet supply table downward by the vertically moving device in response to detection by the sheet supply position detecting device when the left and right movement instructing device gives the instruction.

According to a third aspect of the present invention, in the second aspect, there is provided a sheet supply apparatus wherein the control device executes a control of moving the sheet supply table left and right by the left and right moving device after executing a control of moving the sheet supply table downward by the vertically moving device.

According to a fourth aspect of the present invention, in the second aspect, there is provided a sheet supply apparatus wherein the control device executes a control of moving the sheet supply table upward by the vertically moving device to allow the topmost record sheet to be situated to the sheet supply position after executing a control of moving the sheet supply table left and right by the left and right moving device.

According to a fifth aspect of the present invention, in the second aspect, there is provided a sheet supply apparatus wherein the left and right movement instructing device includes a left and right moving key for moving the sheet supply table in either desired direction of left and right directions; and wherein the control device executes a control of moving the sheet supply table in the left and right direction by a constant amount in a corresponding direction each time of operating the left and right movement instructing device by one time.

According to a sixth aspect of the present invention, in any one of the second through the fourth aspects, there is provided a sheet supply apparatus wherein the control device executes a control of moving the sheet supply table vertically and in the left and right direction while the sheet supply device does not function.

According to a seventh aspect of the present invention, in any one of the second through the fourth aspects, there is provided a sheet supply apparatus wherein the control device temporarily halt functioning of the sheet supply device while controlling the sheet supply table to move vertically and in the left and right direction.

According to the above-described constitution, the record sheets are loaded on the sheet supply table, and the topmost one of the record sheets on the sheet supply table is brought into contact with the sheet supply means and is supplied to the image forming apparatus one by one. The sheet supply table is moved upward by the vertically moving means according to sheet supplying operation, and the record sheets are supplied one by one from the topmost one situated to the sheet supply position.

When instruction is inputted into the control means by depressing the left and right movement key to move an image forming position on the record sheet in the left and right direction, the control means moves the sheet supply table downward to leave the record sheet. Then, the left and right moving means moves the sheet supply table in the left and right direction. Thus, the record sheet can move in the left and right direction while not contacting the sheet supply means, thereby preventing from being rubbed.

Then, the sheet supply table is controlled to move upward. When the topmost record sheet is positioned to the sheet supply position, the sheet supplying operation is resumed.

BRIEF DESCRIPTION OF THE DRAWINGS

FIG. 1(*b*) is a plane view showing the embodiment of the sheet supply apparatus according to the present invention;

DETAILED DESCRIPTION OF PREFERRED EMBODIMENTS

Figure 1:
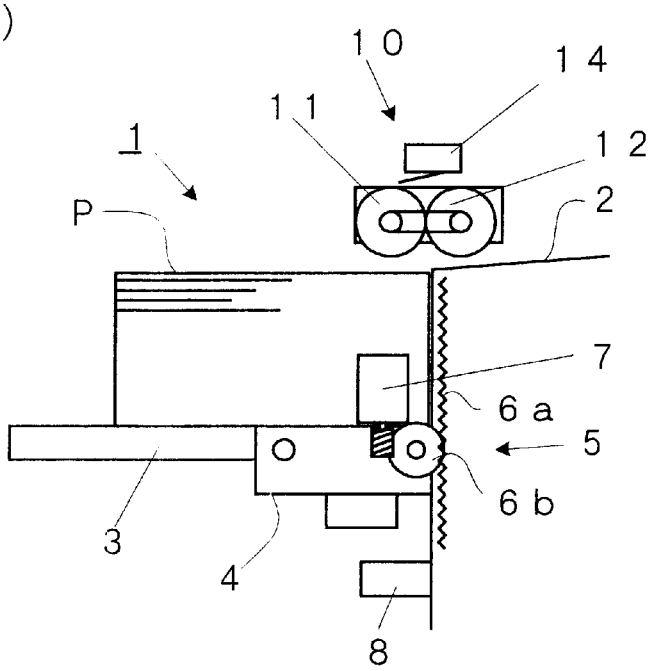
FIG. 1(*a*) is a side view showing an embodiment of a sheet supply apparatus according to the present invention.
Figure 1:
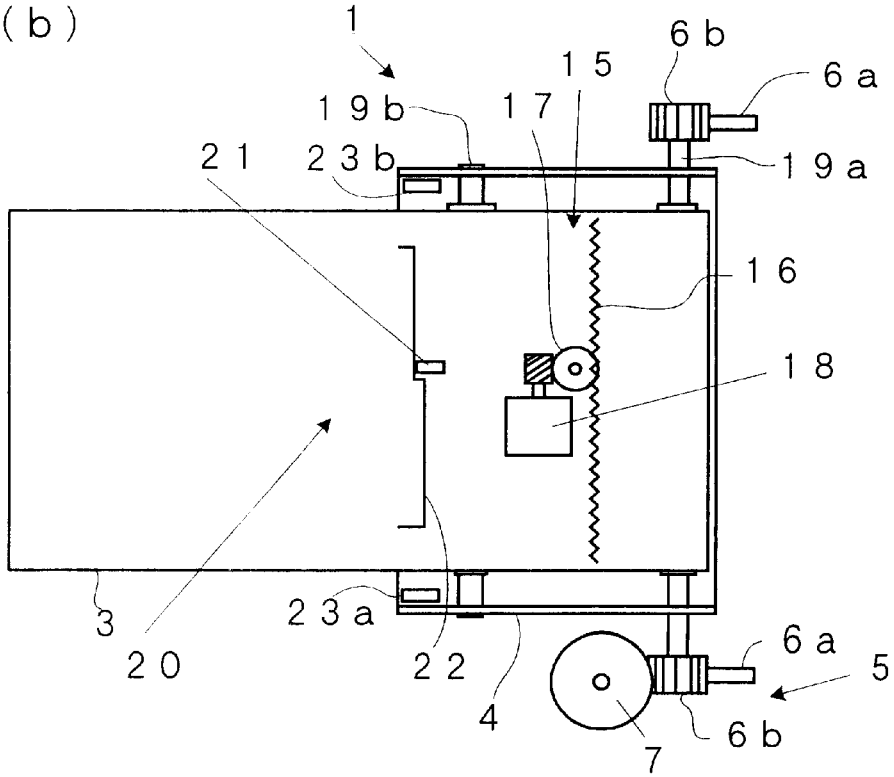

FIGS. 1(*a*) and 1(*b*) are views showing a sheet supply apparatus according to the present invention. FIG. 1(*a*) is a side view and FIG. 1(*b*) is a plane view.

A sheet supply apparatus 1 is provided on one side (left side in the drawing) of an image forming apparatus 2 and is provided with a sheet supply table 3 capable of supporting record sheets (hereinafter, referred to as print sheets) P of a predetermined number.

The sheet supply table 3 is provided above a hold frame 4 and can be moved vertically by an elevating means 5. The elevating means 5 is constituted by a pair of rack gears 6*a* provided on the side of the image forming apparatus 2 and extended in the up and down direction and pinion gears 6*b* provided on the side of the sheet supply table 3 and in mesh with the rack gears 6*a*. The pinion gears 6*b* are driven to rotate by an elevator motor 7 by which the sheet supply table 3 can be moved to elevate or lower. A lower limit sensor 8 detects a lower limit position of the sheet supply table 3 in lowering the sheet supply table 3.

Further, the image forming apparatus 2 is provided with sheet supply means 10 which can be brought into contact with the print sheet P at the topmost face above the sheet supply table 3. The sheet supply means 10 is constituted by a scraper roller 11 and a pickup roller 12 and is driven to rotate intermittently in synchronism with printing operation to thereby charge the print sheet P to inside of the image forming apparatus 2 one by one.

The print sheet P is brought into contact with the scraper roller 11 of the sheet supply means 10 at the sheet supply position under predetermined pressure by controlling to elevate the sheet supply table 3. The contact pressure differs according to kinds of the print sheet P such as a thickness thereof. The contact pressure of the sheet supply means 10 is detected by an upper limit sensor (sheet supply position detecting means) 14 and is outputted to a control section and control means controls to elevate or lower the sheet supply table 3 such that sheet can be supplied always under optimum contact pressure. Thereby, stable supply can be carried out by preventing laminated feed or vacant feed in supplying the print sheet P.

Further, the sheet supply table 3 can be moved in the left and right direction (direction orthogonal to transfer direction of print sheet P: width direction of print sheet P) relative to the image forming apparatus 2 within the hold frame 4 by left and right moving means 15.

That is, on the side of the sheet supply table 3, a rack gear 16 is provided and on the side of the hold frame 4, a pinion gear 17 in mesh with the rack gear 16 and a left and right moving motor 18 for driving are provided. The sheet supply table 3 is moved in the left and right direction relative to the hold frame 4 by driving to rotate the left and right moving motor 18.

Further, the sheet supply table 3 is held by the hold frame 4 to be able to move in the left and right direction by support shafts 19*a* and 19*b* extended in the left and right direction. Among the support shafts 19*a* and 19*b*, both ends of the support shaft 19*a* are fixed with the pinion gears 6*b* of the elevating means 5.

An original point (home position) of the position of the sheet supply table 3 in the left and right direction is detected by original point detecting means 20. The original point detecting means 20 is constituted by an original point sensor 21 of a light projection and reception integrated type fixed to a central position in the left and right direction (width direction) of the hold frame 4 and a shield plate 22 provided on the side of the sheet supply table 3 for shielding (or transmitting) light from the original point sensor 21 when the sheet supply table 3 is disposed at the central position in the left and right direction.

Further, the hold frame 4 is provided with a right limit switch 23*a* and a left limit switch 23*b* for detecting right and left limit positions of the sheet supply table 3 above the hold frame 4.

Figure 2:
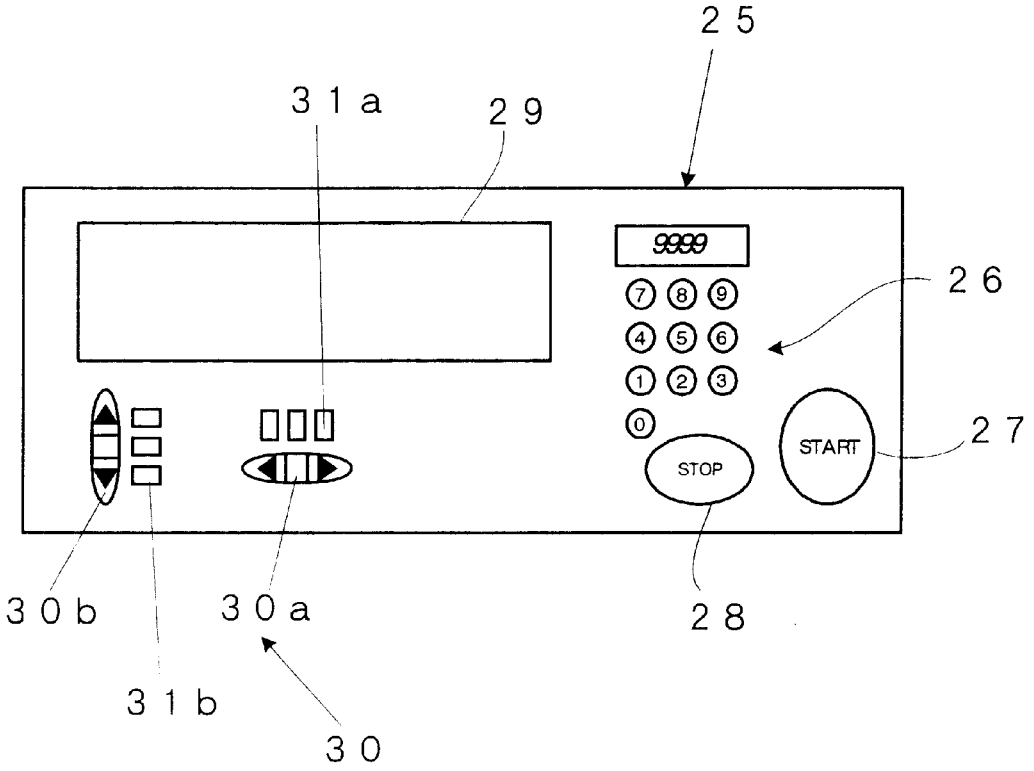
FIG. 2 is a view showing an operation panel.

FIG. 2 is a view showing an operation panel 25 provided at the image forming apparatus 2. The operation panel 25 is provided with a set key 26 for setting a number of printed sheets or the like, a print operation start key 27, a stop key 28, a display portion 29 for displaying set content or print state and the like.

Further, there is provided image position adjusting means 30 for adjusting a position of forming an image on the print sheet P. The image position adjusting means 30 is constituted by a vertically moving key 30*a* for adjusting a vertical position (up and down position) of the image relative to the print sheet P and a left and right moving key (left and right moving instruction means) 30*b* for adjusting a left and right position orthogonal to the vertical position.

In correspondence with operation of the vertically moving key 30*a*, at inside of the image forming apparatus 2, the vertical position of the image relative to the print sheet P is adjusted by making variable a transfer state of the print sheet P. The state of the vertical adjustment is displayed by a vertical position displaying portion 31*a* comprising LED (Light Emitting Diode) or the like.

The left and right moving key 30*b* is constituted by a key for moving the sheet supply table 3 in the left direction, a key for moving the sheet supply table 3 in the right direction and a key for returning the sheet supply table 3 to the original point.

When the left and right moving key 30*b* is operated, the left and right moving motor 18 of the sheet supply table 3 is driven, the sheet supply table 3 is moved in the left and right direction and the left and right position of the image relative to the print sheet P is adjusted. The state of the left and right adjustment is displayed by a left and right display portion 31*b* comprising LED or the like.

These adjustments are controlled to operate by control means, mentioned later.

Further, when the left and right position is adjusted, the elevator motor 7 is to be driven together with the left and right moving motor 18, as is explained in detail later.

Figure 3:
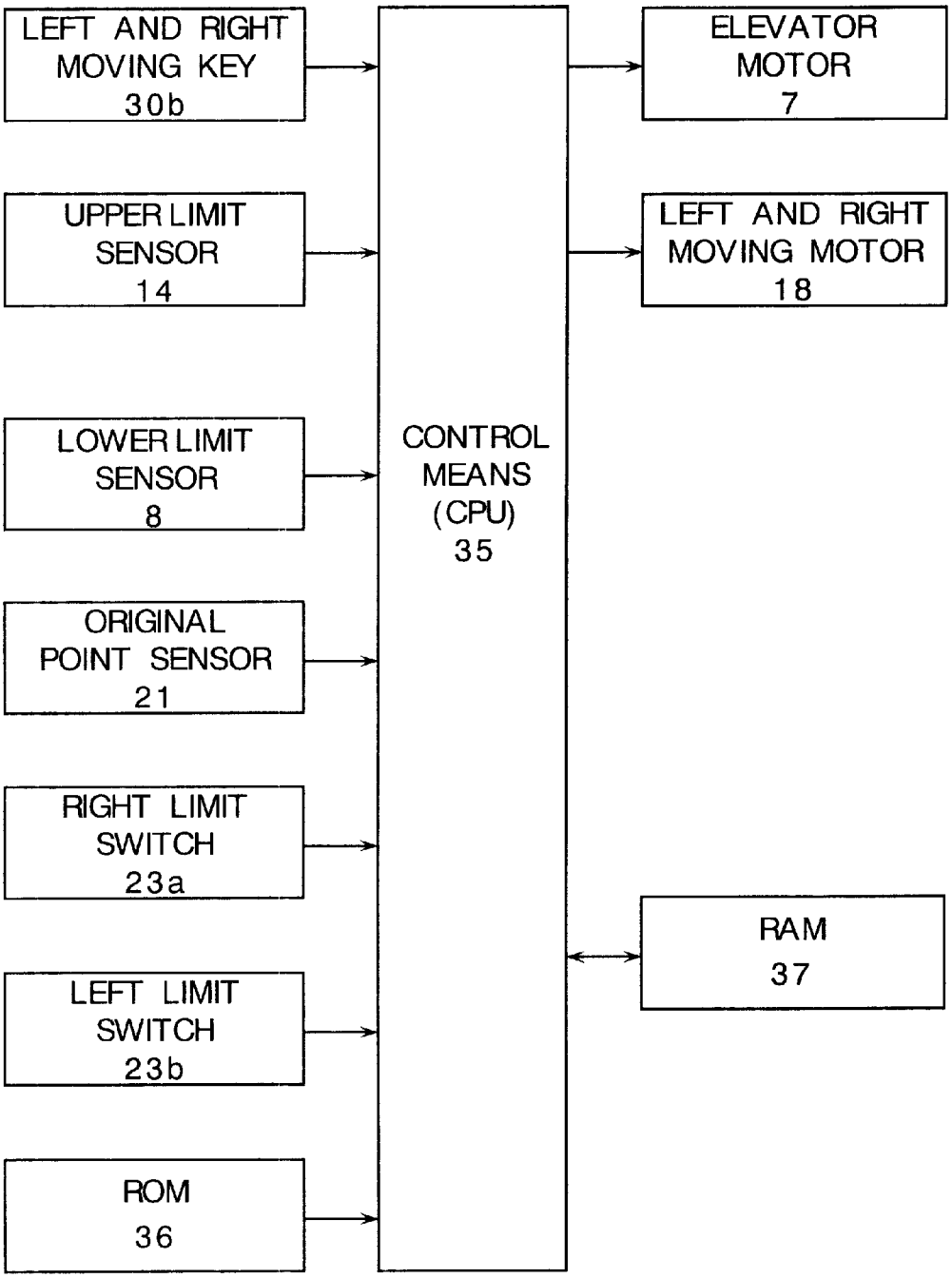
FIG. 3 is a block diagram showing an electrical constitution of the sheet supply apparatus.

FIG. 3 is a block diagram showing an electrical constitution of the apparatus.

Control means 35 is constituted by a microprocessor (CPU). The control means 35 executes control program stored in ROM 36 and executes sheet supply control, mentioned later, by temporarily using RAM 37 for storing data. Hereinafter, an explanation will be given mainly of left and right movement control constituting an essential portion of the present invention.

The control means 35 is inputted with respective detected signals of the lower limit sensor 8, the upper limit sensor 14, the original point sensor 21, the right limit switch 23*a*, the left limit switch 23*b*. Further, an operating signal of the left and right moving key 30*b* is inputted thereto.

The control means 35 adjusts the left and right position of the sheet supply table 3 by controlling to drive the elevator motor 7 and the left and right moving motor 18 based on the detected signals and the operating signal.

An explanation will be made to controlling the left and right movement of the sheet supply table 3 with reference to a timing chart of FIG. 6 and flow charts of FIGS. 4 and 5.

Figure 6:
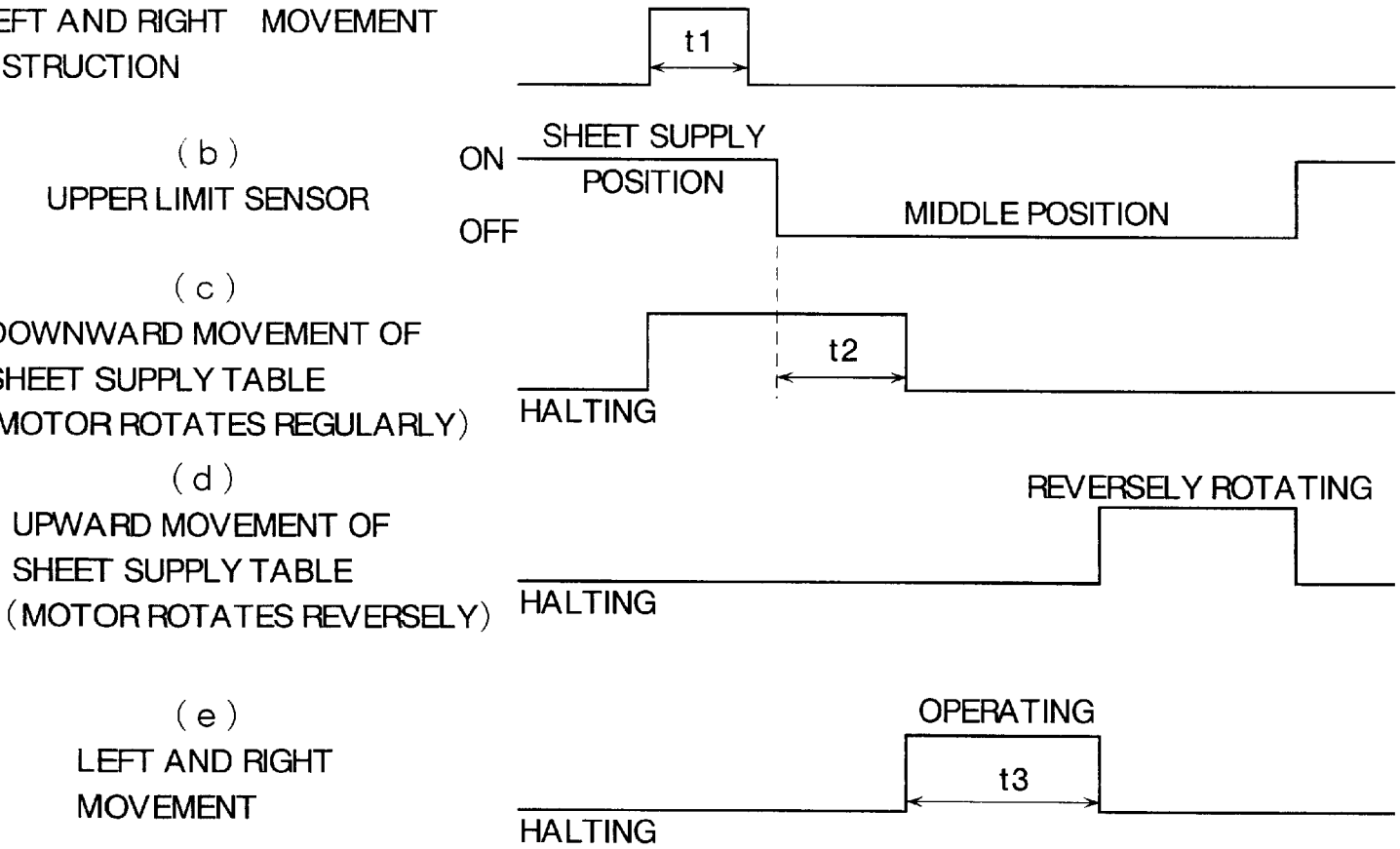
FIG. 6 is a timing chart No.1 showing control content of movement of a sheet supply table in the left and right direction.

When the left and right movement key 30*b* is depressed once (time period tl of FIG. 6(*a*)), the control means 35 starts to control the left and right movement. Then, the topmost print sheet regularly contacts the sheet supply means 10, and the upper limit sensor 14 is made ON (FIG. 6(*b*)). Firstly, whether the print sheet P is positioned to a sheet supply position is detected (SP1). The sheet supply position indicates a state in which the scraper roller 11 of the sheet supply means 10 contacts the print sheet P loaded on the sheet supply base 3 with a predetermined pressure, the upper limit sensor 14 is brought into an ON state and the sheet can be supplied.

Specifically, whether the upper limit sensor 14 is made ON or OFF is detected. When the sensor is detected to be ON, it is judged that the print sheet is positioned to the sheet supply position, that is, the print sheet P contacts the scraper roller 11 with the predetermined pressure (SP1-YES). When detected OFF, it is judged that the print sheet is positioned otherwise, that is, the print sheet P does not contact the scraper roller 11.

When it is judged that the print sheet is positioned to the sheet supply position (SP1-YES), a control of moving the sheet supply table 3 by a constant amount is conducted (SP2). Specifically, the elevator motor 7 is driven to rotate regularly until the lower limit sensor 8 is made OFF, thereby moving the sheet supply table 3 downward by a constant amount.

Then, when the lower limit sensor 8 detects the sheet supply table 3 while the print sheet P is placed at the sheet supply position (SP3-YES), an error processing is executed. Such state arises when excessive print sheets over a specific number is loaded on the sheet supply table 3. In this state, the print sheet P remains contacted with the scraper roller 11, it is judged that the print sheet P cannot move in the left and right direction and the error processing is executed (SP4). In the error processing, the condition where the print sheet cannot move in the left and right direction or the excessive loading of the print sheets P on the sheet supply table is displayed on the display portion 29.

Otherwise, in the case where the sheet supply table 3 is not detected when it starts to move downward (SP3-NO), the sheet supply position is again detected (SP5). That is, it is confirmed that the upper limit sensor 14 is made OFF.

Then, when presence of the print sheet on the sheet supply position is confirmed (SP5-YES), the operation is returned to SP2 and the sheet supply table 3 is moved downward. When presence of the print sheet on the sheet supply position is not confirmed (SP5-NO), the sheet supply table 3 is moved downward (SP6).

When the sheet supply table 3 is detected at the lower limit position (SP7-YES), the downward movement thereof is halted by stopping the elevator motor 7 (SP9).

Here, when the sheet supply table 3 is not detected at the lower limit position (SP7-NO), the downward movement thereof is continued until at least a predetermined time period t2 elapses (loop of SP8). Here, the predetermined time period t2 (FIG. 6(*c*)) is set long enough for the print sheet P to exit from the contacting state with the scraper roller 11.

According to the control explained above, the sheet supply table 3 is positioned to the lower limit position or an intermediate position between the upper and the lower positions through the control of the downward movement, thereby allowing the print sheet P to be positioned below the scraper roller 11 having a distance therebetween.

Next, the control means 35 executes a control of the left and right movement (SP10). FIG. 5 is a flowchart showing detailed content of the control in the left and right movement.

Initially, operation of the left and right moving key 30*b* is judged on whether it is executed in the right direction or in the left direction (SP20). In the case of operating the left and right moving key 30*b* in the right direction (SP20-YES), the operation moves the sheet supply table 3 in the right direction by regularly rotating the left and right moving motor 18 (SP22) during a time period until the sheet supply table 3 is detected by the right limit switch 23*a* (SP21-NO).

During the time period in which the sheet supply table 3 can be moved in the right direction, the left and right moving motor 18 is regularly rotated continuously until a constant time period t3 (FIG. 6(*e*)) elapses by pressing down the left and right moving key 30*b* once (loop of SP23). The constant time period t3 is set to a time period of moving the sheet supply table 3 by, for example, 0.5 mm.

After the sheet supply table 3 moves for the constant time period t3, the left and right moving motor 18 stops regular rotation thereof, thereby temporarily halting the movement of the sheet supply table 3 in the right direction (SP24).

Afterward, in the case where the left and right moving key 30*b* is continuously depressed (SP25-YES), the operation is returned to SP20 and the processing explained above is repeated.

Figure 4:
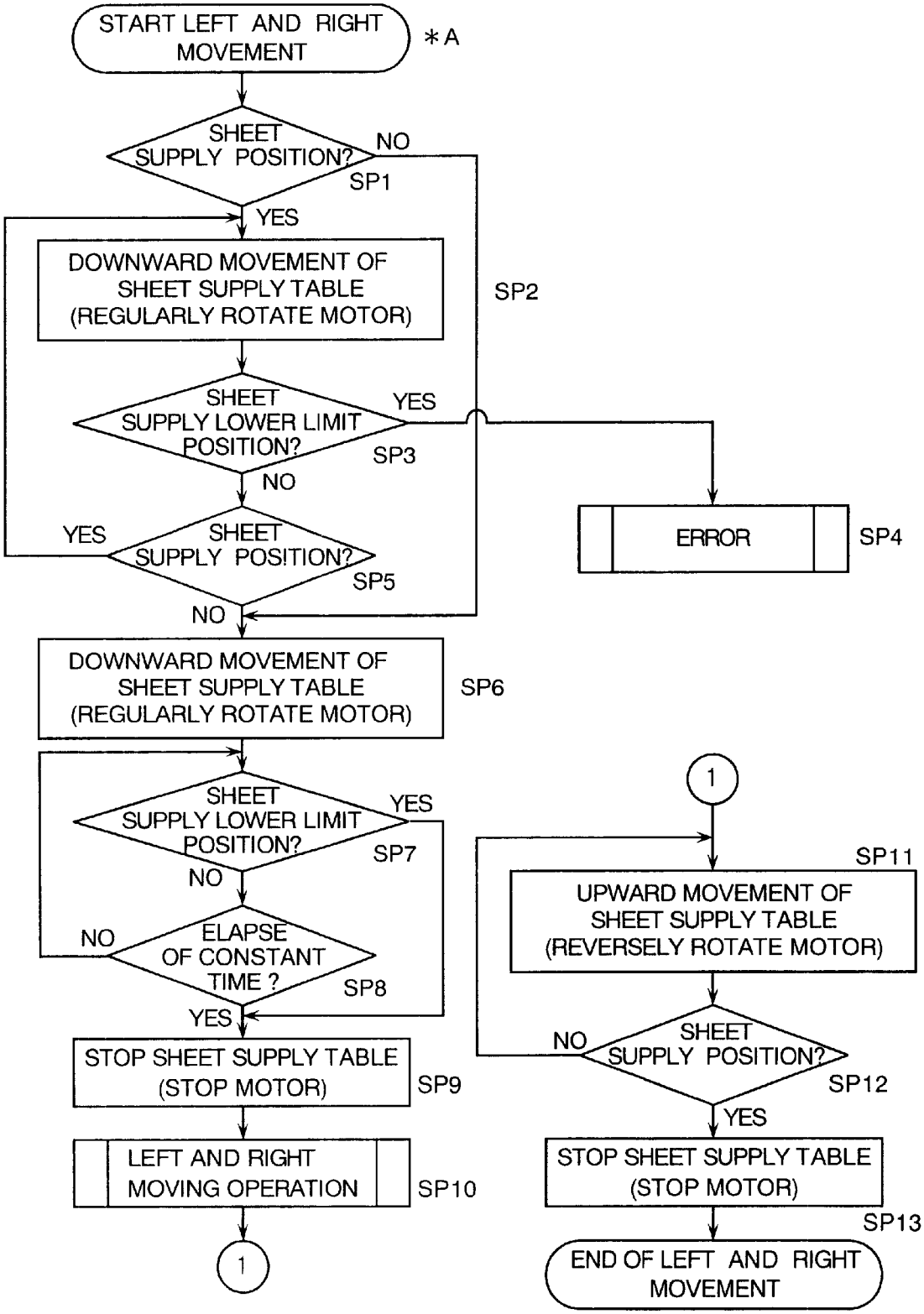
FIG. 4 is a flowchart No.1 showing control content of movement of a sheet supply table in the left and right direction.

In the meantime, the control processing of left and right movement is finished either in the case in which the left and right moving key 30*b* is released (SP25-NO) and in the case in which the sheet supply table 3 is detected to reach the right limit position by the right limit switch 23*a* (SP21-YES), and then the operation is transferred to the flow chart as shown in FIG. 4 (SP11).

Further, in the control of the left and right movement, in the case of operating the left and right moving key in the right direction (SP20-NO), processes at SP21 to SP25 are identical to those in the case of the left movement except of the moving direction, thus the explanation thereof is omitted. In this case, the left limit switch 23*b* is used for detecting the sheet supply table instead of the right limit switch 23*a*.

According to the operation explained above, when the left and right moving key 30*b* is depressed, the sheet supply table 3 moves once downward so that the print sheet P departs from the sheet supply means 10 and then moves in the left and right direction. Therefore, the print sheet P can be moved in the left and right direction without contacting the scraper roller 11, so that the sheet does not move in an oblique direction and damages to a print area thereof is decreased.

After the sheet supply table 3 moves in the left and right direction, processing shown at SP11 and thereafter is executed.

While moving in the left and right direction, the sheet supply table 3 is vertically positioned to the lower limit position or the intermediate position between the upper and the lower positions. Accordingly, the elevator motor 7 is reversely driven to move the sheet supply table 3 upward for executing printing afterwards (SP11, FIG. 6(*d*)).

This upward movement is continued until the upper limit sensor 14 is made ON, that is, until the print sheet P comes into contact with the scraper roller 11 of the sheet supply means 10 with the predetermined pressure at the sheet supply position (loop of SP12).

Then, when the upper limit sensor 14 detects the print sheet on the sheet supply position (SP12-YES), the elevator motor 7 is halted to stop the upward movement of the sheet supply table 3 (SP13).

Upon completion of the control of the upward movement, the entire control of the left and right movement is finished. The print sheet P as adjusted in the left and right direction can be supplied immediately to execute printing.

Figure 7:
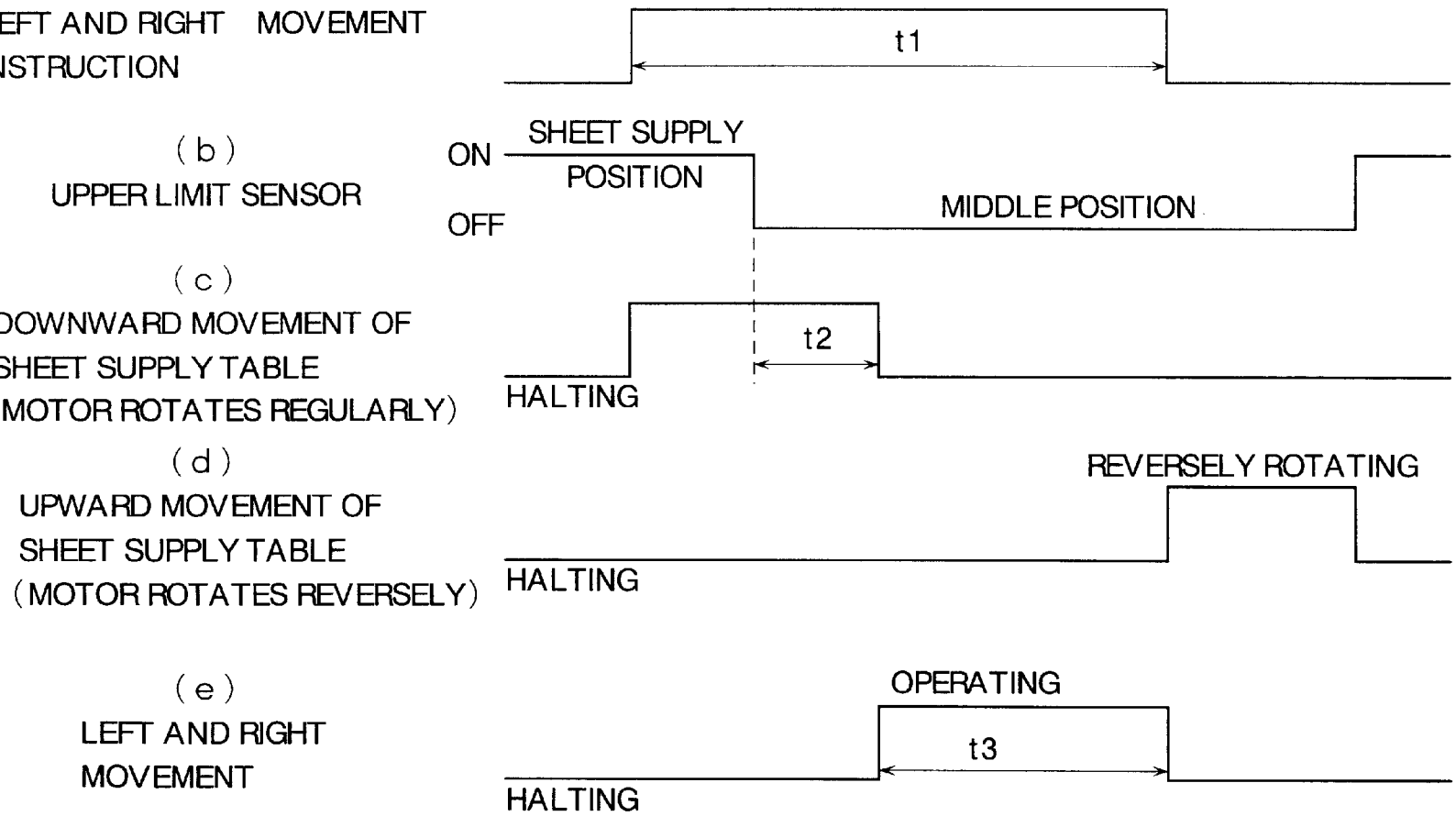
FIG. 7 is a timing chart No.2 showing control content of movement of a sheet supply table in the left and right direction.

Next, FIG. 7 is a timing chart showing a control in which the left and right moving key 30*b* is continuously depressed.

As shown in FIG. 7(*a*), the left and right moving key 30*b* is sometimes depressed continuously for relatively a long time (time period t1). This operation is executed when the sheet supply table 3 is required to move long in the left and right direction.

Even when the operation is carried out, the control means 35 invariably executes the control processing of SP1 through SP10 according to the flowchart shown in FIG. 4.

However, when the control of the left and right movement (SP20–SP25) is executed, it is judged that the left and right moving key 30*b* remains being depressed (SP25-YES) since the left and right moving key 30*b* has been continuously depressed during the control.

Thus, the operation returns to SP20 and the left and right moving motor 18 is continuously driven (FIG. 7(*e*)) so that the left and right movement is continued while the left and right moving key 30*b* is depressed. Namely, the time period t3 during which the left and right moving motor 18 is continuously driven is variable according to timing when the depressed left and right moving key 30*b* is released.

Upon releasing the depressed left and right moving key 30*b*, the left and right movement is halted (SP25-NO), and the operation is transferred to the control of the upward movement of the sheet supply table 3 as shown in SP11 and thereafter.

The control of the left and right movement of the sheet supply table 3 can be achieved either in sheet supplying time, i.e. printing time, or in not-supplying time, i.e. not-printing time. In the case of the sheet supplying time, the sheet supply table 3 is controlled to move downward so as to temporarily halt sheet supplying, i.e. printing.

Figure 8:
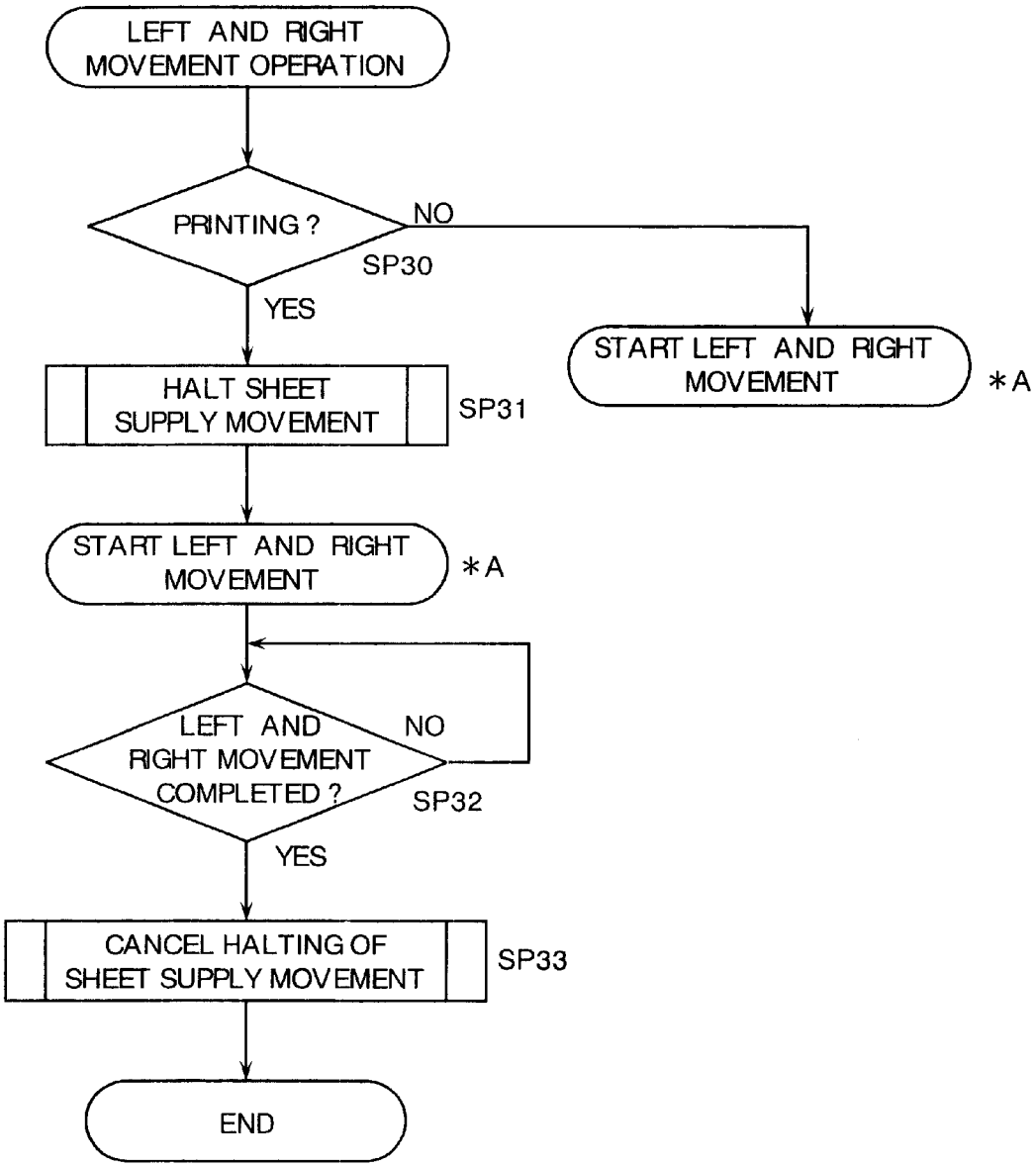
FIG. 8 is a flowchart showing another example of control of movement of a sheet supply table in the left and right direction.
Figure 9:
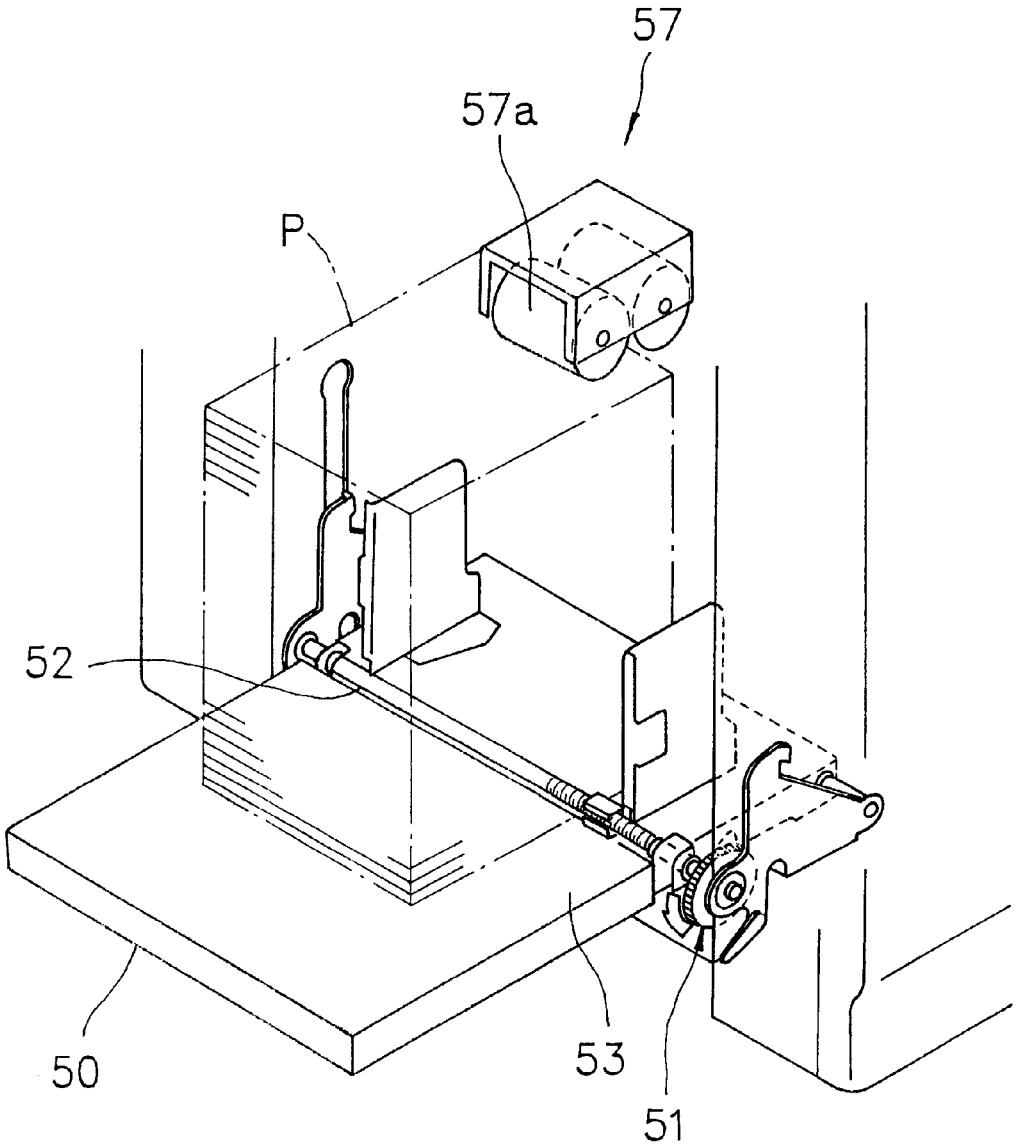
FIG. 9 is a perspective view showing a sheet supply apparatus.

Next, another example of control by the control means 35 will be explained referring to a flow chart of FIG. 8.

This flow chart shows control that is appropriately executed by judging whether printing is conducted when the sheet supply table 3 is operated to move in the left and right direction by the left and right moving key 30*b*.

The scraper roller 11 and the pick-up roller 12 of the sheet supply means 10 are both driven to rotate in synchronization with printing operation of the image forming apparatus 2, thereby supplying the print sheets P inside the image forming apparatus 2. The sheet supply means 10 is constituted such that it supplies the print sheets P one by one according to printing speed by intermittently functioning a not-shown sheet supply clutch such as an electromagnetic clutch.

Firstly, when the left and right moving key 30*b* is depressed, the control means 35 judges whether printing is conducted (SP30).

Figure 5:
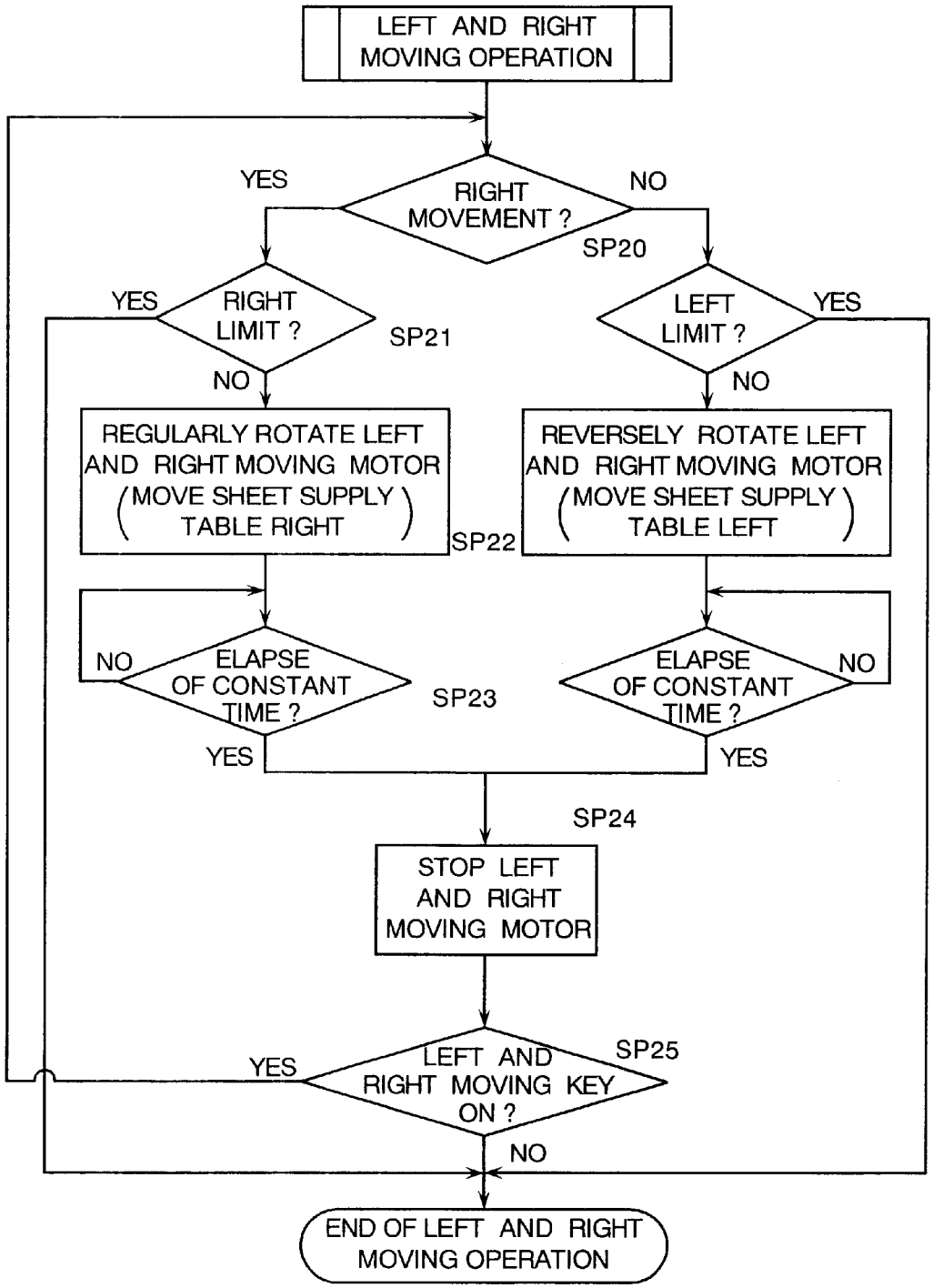
FIG. 5 is a flowchart No.2 showing control content of movement of a sheet supply table in the left and right direction.

In the case where printing is not conducted (SP30-NO), the control of the left and right movement is started as shown in FIGS. 4 and 5 (SP1 and thereafter).

In the case where it is judged that printing is conducted when the left and right moving key 30*b* is depressed (SP30-YES), a process of temporarily halting the sheet supply by the sheet supply means 10 is executed (SP31).

Specifically, the sheet supply clutch that functions in synchronization with printing operation of the image forming apparatus 2 is forced to be released, thereby temporarily halting supplying or conveying operation of the print sheet P by the scraper roller 11 and the pick-up roller 12.

Then, in the state where the sheet supply means 10 halts in sheet supplying operation, the control of the left and right movement is started as shown in FIGS. 4 and 5 (SP1 and thereafter).

After each process of SP1 to SP13 is executed to finish the left and right movement (SP32-YES), halting of the sheet supply is cancelled (SP33). Namely, the sheet supply clutch is released from the OFF state.

According to the control described above, the sheet supplying operation or the printing operation can be started again by canceling the temporarily halted sheet supplying at the sheet supply means 10.

Thus, the sheet supplying operation can be halted at the sheet supply apparatus and the printing operation of the image forming apparatus 2 driven in association with the sheet supplying operation also can be halted.

According to a first aspect of the present embodiment, the sheet supply table moves downward when the image forming position on the print sheet is adjusted in the left and right direction, so that the sheet supply table can move in the left and right direction without generating friction between the print sheet and the sheet supply means. Further, jamming in the sheet supply due to oblique movement of the print sheet can be prevented. Still further, the image forming position can be moved in the left and right direction without damaging the print sheet. Still more further, required load for the left and right moving means can be decreased.

According to a second aspect of the present embodiment, the effects explained above can be achieved through executing successive movements in which the sheet supply table moves downward on the basis of the instruction for adjusting the image forming position on the print sheet in the left and right direction and moves in the left and right direction as instructed while releasing the print sheet from the sheet supply means. Thus, adjustment of the image forming position in the left and right direction can be executed immediately and reliably.

According to a third aspect of the present embodiment, the print sheet can be restored to the sheet supply position immediately by moving the sheet supply table upward after finishing the adjustment in the left and right direction.

According to a fourth aspect of the present embodiment, one stroke of depressing the left and right moving key determines moving amount in the adjustment, so that the adjustment can be executed subtly in a short time. Further, since a time period during which the sheet supply operation is temporarily halted can be shortened, time required for resuming the sheet supply can be shortened.

According to a fifth aspect of the present embodiment, the adjustment of the sheet supply table in the left and right direction is controlled while the sheet supply is halted, so that the adjustment can be executed without being affected by the sheet supply, thereby effectively preventing friction on the print sheet or conveying failure of the print sheet.

According to a sixth aspect of the present embodiment, control of adjusting the sheet supply table in the left and right direction can be executed prior to the sheet supply, so that adjustment of the image forming position in the left and right direction can be immediately and successfully.

What is claimed is:

1. A sheet supply apparatus for supplying record sheets to an image forming apparatus, said sheet supply apparatus comprising:

a sheet supply table for supporting the record sheets stacked thereon;

vertically moving means for vertically moving the sheet supply table;

sheet supply means provided above the sheet supply table and contacting a topmost one of the record sheets for supplying the record sheets one by one from the one record sheet to the image forming apparatus;

left and right movement instructing means for giving an instruction to move the sheet supply table in a direction orthogonal to a transfer direction of the record sheet;

left and right moving means for moving the sheet supply table in response to an instruction from the left and right movement instructing means; and control means for executing a control of moving the sheet supply table downward by the vertically moving means when the left and right movement instructing means gives the instruction.

2. A sheet supply apparatus for supplying record sheets to an image forming apparatus, said sheet supply apparatus comprising:

a sheet supply table for supporting the record sheets stacked thereon;

vertically moving means for vertically moving the sheet supply table;

sheet supply means provided above the sheet supply table and contacting a topmost one of the record sheets for supplying the record sheets one by one from the one record sheet to the image forming apparatus;

sheet supply position detecting means for detecting whether the topmost record sheet is situated to a sheet supply position where the topmost record sheet is contacted with the sheet supply means;

left and right movement instructing means for giving an instruction to move the sheet supply table in a direction orthogonal to a transfer direction of the record sheet;

left and right moving means for moving the sheet supply table in response to an instruction from the left and right movement instructing means; and control means for executing a control of moving the sheet supply table downward by the vertically moving means in response to detection by said sheet supply position detecting means when the left and right movement instructing means gives the instruction.

3. The sheet supply apparatus according to claim 2, wherein the control means executes a control of moving the sheet supply table left and right by the left and right moving means after executing a control of moving the sheet supply table downward by the vertically moving means.

4. The sheet supply apparatus according to claim 2, wherein the control means executes a control of moving the sheet supply table upward by the vertically moving means to allow the topmost record sheet to be situated to the sheet supply position after executing a control of moving the sheet supply table left and right by the left and right moving means.

5. The sheet supply apparatus according to claim 2, wherein the left and right movement instructing means includes a left and right moving key for moving the sheet supply table in either desired direction of left and right directions; and wherein the control means executes a control of moving the sheet supply table in the left and right direction by a constant amount in a corresponding direction each time of operating the left and right movement instructing means by one time.

6. The sheet supply apparatus according to claim 2, wherein the control means executes a control of moving the sheet supply table vertically and in the left and right direction while the sheet supply means does not function.

7. The sheet supply apparatus according to claim 2, wherein the control means temporarily halt functioning of the sheet supply means while controlling the sheet supply table to move vertically and in the left and right direction.

* * * * *